US006181907B1

(12) United States Patent
Hong

(10) Patent No.: US 6,181,907 B1
(45) Date of Patent: Jan. 30, 2001

(54) PAPER SUPPLY CONTROL APPARATUS IN PRINTER AND PAPER SUPPLYING METHOD

(75) Inventor: Seung-ho Hong, Suwon (KR)

(73) Assignee: Samsung Electronics Co., Ltd., Kyungki-do (KR)

( * ) Notice: Under 35 U.S.C. 154(b), the term of this patent shall be extended for 0 days.

(21) Appl. No.: 09/473,998

(22) Filed: Dec. 29, 1999

(30) Foreign Application Priority Data

Jan. 7, 1999 (KR) ..... 99-163

(51) Int. Cl.[7] ..... G03G 15/00
(52) U.S. Cl. ..... 399/394; 399/388
(58) Field of Search ..... 399/301, 361, 399/381, 388, 394; 347/116

(56) References Cited

U.S. PATENT DOCUMENTS

| | | | | |
|---|---|---|---|---|
| 4,541,711 | * | 9/1985 | Takahashi | 399/394 |
| 4,589,765 | * | 5/1986 | Perun et al. | 399/388 X |
| 5,278,623 | * | 1/1994 | Kasahara et al. | 399/394 |
| 5,291,223 | * | 3/1994 | Ogane et al. | 347/116 |
| 5,339,150 | * | 8/1994 | Hubble, III et al. | 347/116 X |
| 5,355,206 | * | 10/1994 | Maruyama et al. | 399/394 X |
| 5,550,625 | * | 8/1996 | Takamatsu et al. | 339/301 |

FOREIGN PATENT DOCUMENTS

| | | |
|---|---|---|
| 62-62372 | 3/1987 | (JP) . |
| 2-139578 | 5/1990 | (JP) . |
| 10-240098 | 9/1998 | (JP) . |

* cited by examiner

*Primary Examiner*—Sandra Brase
(74) *Attorney, Agent, or Firm*—Sughrue, Mion, Zinn, Macpeak & Seas, PLLC

(57) ABSTRACT

A paper supply controlling apparatus in a printer and a paper supply method are provided. The paper supply controlling apparatus includes a pickup roller for picking up sheets of paper loaded in a paper feeding cassette, a pickup roller driving portion for driving the pickup roller, a recognition pattern detecting sensor for detecting passage of a recognition pattern formed on a circulating photoreceptor belt and outputting a recognition pattern arrival signal, and a paper pickup timing correction portion for determining a variation in the circulation cycle of the photoreceptor belt from the generation interval between the recognition pattern arrival signals, and controlling the pickup roller driving portion so that the time for picking up a sheet of paper from the paper feeding cassette on the basis of the time when the recognition pattern arrival signal is received is compensated for using the variation. Accordingly, a paper pickup time is controlled in response to a variation in the circulation cycle of a photoreceptor belt so that the supplying interval between sheets of paper to be sequentially picked up from a paper feeding cassette is not narrowed below a predetermined interval. Therefore, generation of a paper jam between supplied sheets of paper is prevented, so that the number of image printing errors is reduced.

6 Claims, 4 Drawing Sheets

PAPER SUPPLY CONTROL APPARATUS IN PRINTER AND PAPER SUPPLYING METHOD

BACKGROUND OF THE INVENTION

1. Field of the Invention

The present invention relates to a paper supply control apparatus in a printer and a paper supply method, and more particularly, to a paper supply control apparatus in a printer capable of controlling the paper supply time in response to variations in the circulation cycle of a photoreceptor belt, and a paper supply method for the same.

2. Description of the Related Art

Referring to FIG. 1, a printer includes a printing portion 10 and a paper supplying portion 30 for supplying a sheet of paper to the printing portion 10.

The printing portion 10 is comprised of a photoreceptor belt 14, a reset device 15, optical scanning devices 16, developers 17, a drying unit 18, and a transfer unit 19.

The reset device 15 includes an exposing device 15*a* for projecting light onto electrostatic latent images remaining on the photoreceptor belt 14 circulated by a plurality of rollers 11, 12 and 13 to erase the electrostatic latent images, and a charger 15*b* for charging the photoreceptor belt 14 with a predetermined potential to write new electrostatic latent images on the photoreceptor belt 14.

The optical scanning devices 16 form electrostatic latent images on the photoreceptor belt 14 by scanning light corresponding to image information.

The developers 17 develop electrostatic latent images formed on the photoreceptor belt 14 by the optical scanning device 16, using developing agents.

The drying unit 18 is used when a developing solution mixed with a toner and a liquid carrier element is used as the developing agent. The drying unit 18 absorbs and evaporates the liquid carrier element, which does not participate in forming images, from the photoreceptor belt 14.

The transfer unit 19 transfers images formed with toner on the photoreceptor belt 14 to a fed sheet of paper 31.

The paper supplying portion 30 is comprised of a paper feeding cassette 32, a pickup roller 33 for picking up sheets of paper 31 placed in the paper feeding cassette 32, and a plurality of transfer rollers 35 installed along a paper transfer path 34 ranging from the pickup roller 33 to the transfer unit 19 in the printing portion 10 in order to transfer a picked-up sheet of paper 31.

Reference numeral 40 is a recognition pattern detecting sensor including an optical source 41 and an optical detector 42. As shown in FIG. 2, at a fixed position, the recognition pattern detecting sensor 40 detects passage of a recognition pattern 43 formed at a predetermined position departing from an image writing area D on the photoreceptor belt 14, and outputs a signal indicating the arrival of the recognition pattern 43.

Meanwhile, a sheet of paper 31 must be fed to the transfer unit 19 in accordance with the time when toner images formed on the photoreceptor belt 14 are transferred to the transfer unit 19.

To do this, in the prior art, an engine controller (not shown) sets the time to form images on the photoreceptor belt 14 on the basis of receiving the recognition pattern arrival signal from the recognition pattern detecting sensor 40, and the time required for paper pickup such that they are matched to an image transfer time. The image transfer time is the time it takes to transfer images formed on the photoreceptor belt 14 to a picked-up sheet of paper 31. Thus, the engine controller, which controls the printing portion 10 and the paper supplying portion 30, drives the pickup roller 33 to pick up a sheet of paper 31 at a predetermined paper pickup time after a counted time from receiving the recognition pattern signal. Simultaneously, the engine controller drives the optical scanning device 16 to form images on the photoreceptor belt 14 whenever the counted time is consistent with the image transfer time.

However, a one-time circulation cycle of the photoreceptor belt 14 can be changed according to time. The circulation cycle of the photoreceptor belt 14 can be changed according to variations in power transmitted to the photoreceptor belt 14, a change in ambient temperature, or a change in the total length of the photoreceptor belt 14 due to aging. A variation in the circulation cycle of the photoreceptor belt 14 depending on the above factors can increase with an increase in the total length of the photoreceptor belt 14.

When the circulation cycle of the photoreceptor belt 14 is changed by the above-described factors, the generation interval of the recognition pattern arrival signal is also changed. Consequently, according to the conventional paper pick-up method, the interval between sheets of paper 31 traveling along the paper transfer path 34 is also changed according to a variation in the generation interval of the recognition pattern arrival signal. In particular, when an optical scanning interval for each page and a paper pickup interval corresponding to the optical scanning interval are set to be short to increase printing speed, part of a preceding sheet of paper 31 traveling along the paper transfer path 34 may overlap the following sheet of paper even by a small variation in the circulation cycle of the photoreceptor belt 14, resulting in a printing error.

SUMMARY OF THE INVENTION

To solve the above problem, it is an object of the present invention to provide a paper supply control apparatus and paper supply method in a printer, for controlling the time for picking up a sheet of paper from a paper feeding cassette in response to variations in the circulation cycle of a photoreceptor belt so that the interval between transferred sheets of paper is maintained at or over a predetermined range.

To achieve the above object of the present invention, there is provided a paper supply controlling apparatus in a printer, comprising: a pickup roller for picking up sheets of paper loaded in a paper feeding cassette and transferring the picked-up sheets of paper to a paper supply path leading to a transfer unit in a printer; a pickup roller driving portion for driving the pickup roller; a recognition pattern detecting sensor for detecting the passage of a recognition pattern formed on a circulating photoreceptor belt and outputting a recognition pattern arrival signal; and a paper pickup timing correction portion for determining a variation in the circulation cycle of the photoreceptor belt from the generation interval between the recognition pattern arrival signals, and controlling the pickup roller driving portion so that the time for picking up a sheet of paper from the paper feeding cassette on the basis of the time when the recognition pattern arrival signal is received is compensated for using the variation.

To achieve the above objective of the present invention, there is also provided a paper supplying method in a paper supply controlling apparatus, the method comprising the steps of: (a) setting as initial values a reference value of the circulation cycle of the photoreceptor belt, and reference times of the time for sequentially picking up sheets of paper on the basis of the time when the recognition pattern arrival signal is received; (b) determining whether the recognition pattern arrival signal is received; (c) calculating the generation time interval between a currently-input recognition pattern arrival signal and a previously-input recognition pattern arrival signal, if it is determined in step (b) that the recognition pattern arrival signal is received; (d) obtaining a paper pickup time correction value by subtracting the generation time interval obtained in step (c) from the reference value of the circulation cycle; (e) calculating a paper pickup correction time by adding the paper pickup time correction value to each of the paper pickup reference times; and (f) supplying sheets of paper by driving the pickup roller whenever the paper pickup correction times come on the basis of the time when the recognition pattern arrival signal is received.

BRIEF DESCRIPTION OF THE DRAWINGS

The above objects and advantages of the present invention will become more apparent by describing in detail a preferred embodiment thereof with reference to the attached drawings in which.

DESCRIPTION OF THE PREFERRED EMBODIMENT

Figure 2:
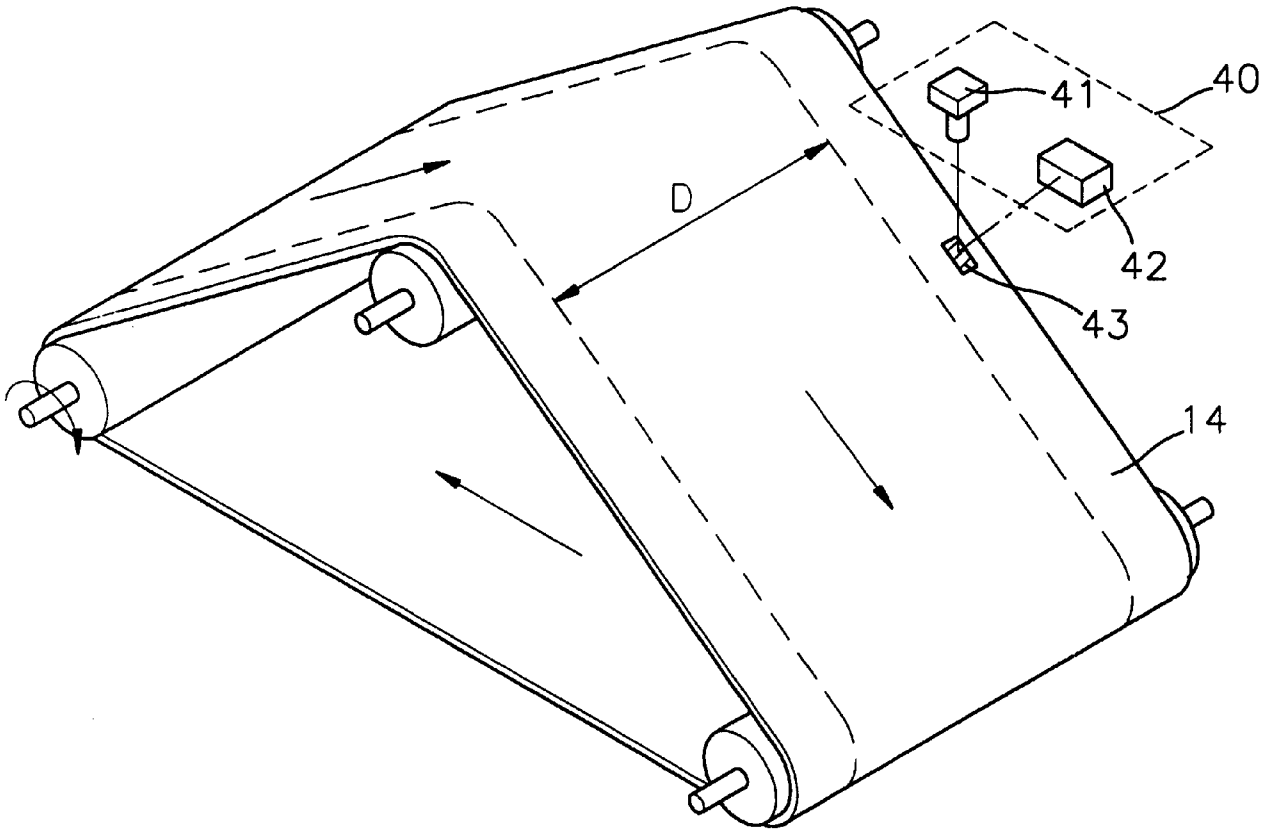
FIG. 2 is a perspective view illustrating some parts of FIG. 1.
Figure 3:
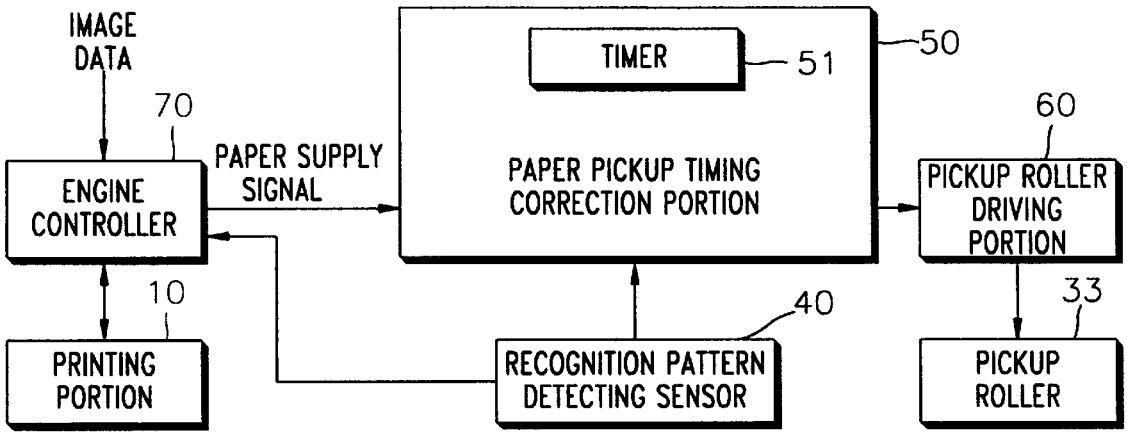
FIG. 3 is a block diagram illustrating a paper supply control apparatus according to the present invention.

FIG. 3 is a block diagram illustrating a paper supply control apparatus according to the present invention. The same elements as those in FIGS. 1 and 2 are denoted by the same reference numerals.

Figure 1:
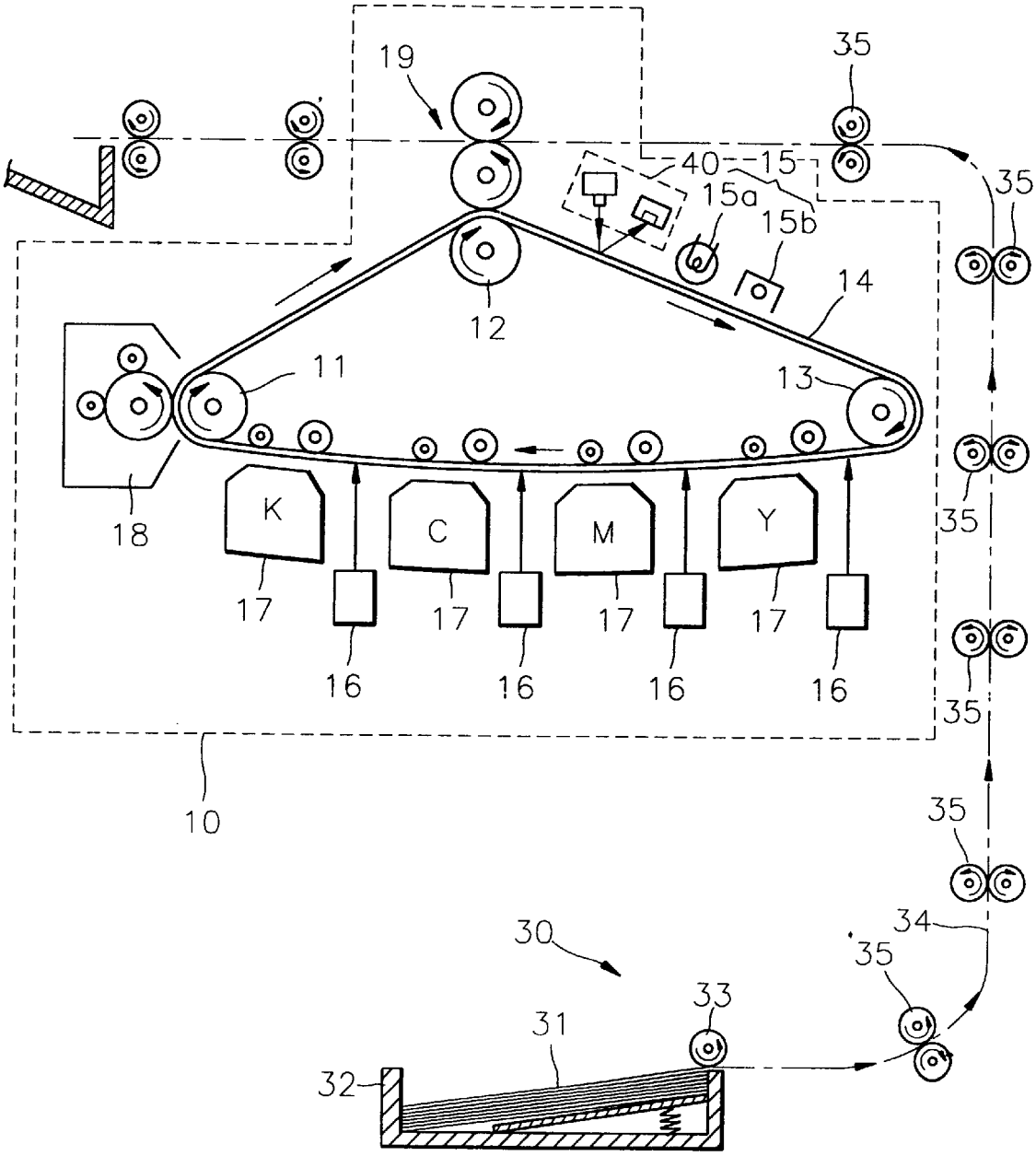
FIG. 1 is a schematic cross-sectional view illustrating a general printer.

Referring to FIGS. 1 through 3, a paper supply control apparatus according to the present invention includes a pickup roller 33, a pickup roller driving portion 60, a paper pickup timing correction portion 50, and a recognition pattern detecting sensor 40.

The pickup roller 33 receives power from the pickup roller driving portion 60 and transfers sheets of paper 31 loaded in a paper feeding cassette 32 to a paper supply path 34 leading to the transfer unit 19 in the printing portion 10.

The recognition pattern detecting sensor 40 detects passage of the recognition pattern 43 formed on the photoreceptor belt 14 using a material having a different reflectivity from the reflectivity of the circulating photoreceptor belt 14, at a fixed position. The recognition pattern detecting sensor 40 outputs a recognition pattern arrival signal when passage of the recognition pattern 43 is detected.

An engine controller 70 controls the printing portion 10 and the paper supply control apparatus. The engine controller 70 outputs a paper supply signal to the paper supply control apparatus and controls the printing portion 10 to form images on the photoreceptor belt 14, when image data is received.

The paper pickup timing correction portion 50 sets a reference value of the circulation cycle of the photoreceptor belt 14 and reference paper pickup times of the time for sequentially picking up sheets of paper 31 on the basis of the point in time when the recognition pattern arrival signal is received, as essential data for calculating a paper pickup correction time. The paper pickup timing correction portion 50 controls the pickup roller driving portion 60 so that sheets of paper 31 are picked up one at a time from the paper feeding cassette 32 at every calculated paper pickup correction time, while counting time in synchronization with the recognition pattern arrival signal from the recognition pattern detecting sensor 40, during output of the paper supply signal from the engine controller 70. The paper pickup correction time is obtained by adding a correction value, obtained by subtracting a recognition pattern arrival signal generation interval time from the reference value of the circulation cycle, to each of the set reference paper pickup times. A timer 51 provided in the paper pickup timing correction portion 50 is reset whenever the recognition pattern arrival signal is received. Hence, the paper pickup timing correction portion 50 obtains the recognition pattern arrival signal generation interval time from a time counted by the timer 51 when the recognition pattern arrival signal is received. The paper pickup timing correction portion 50 drives the pickup roller driving portion 60 whenever the time counted by the timer 51 reaches the paper pickup correction time.

Figure 4:
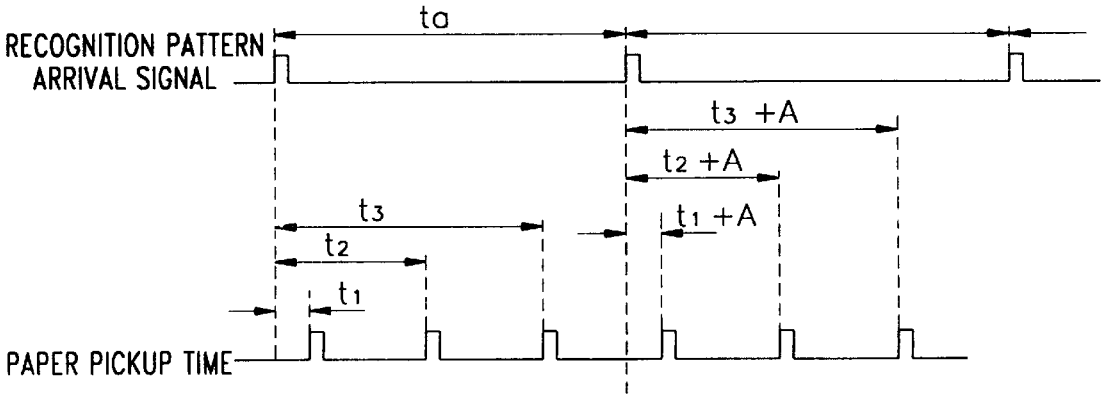
FIG. 4 is a timing view for illustrating a paper supply controlling method according to the present invention.
Figure 5:
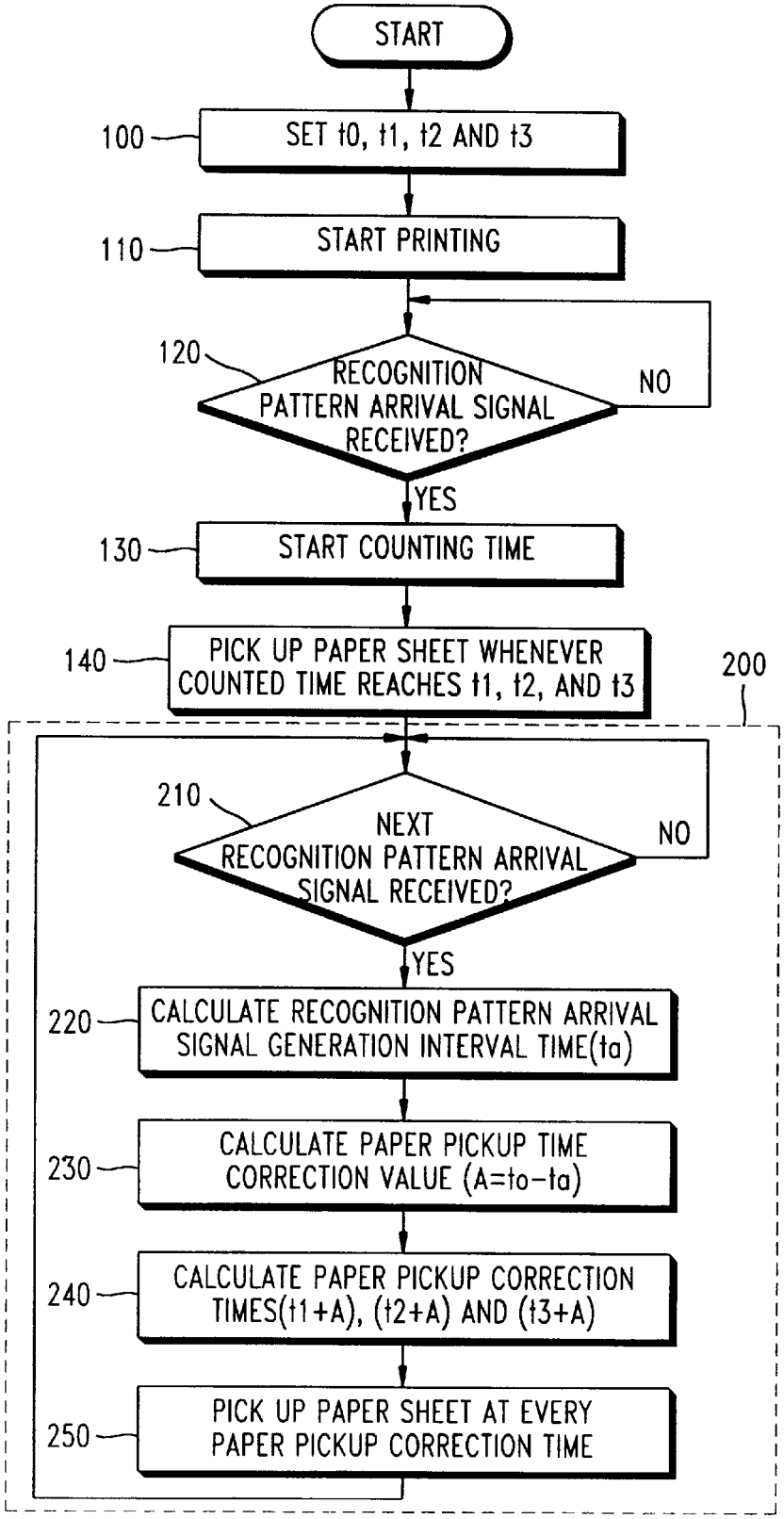
FIG. 5 is a flowchart illustrating a paper supply controlling process according to the present invention.

Hereinafter, a paper supplying process in the paper supply control apparatus will be described with reference to FIGS. 4 and 5 by taking as an example the photoreceptor belt 14 having a length of about 32 inches such that picture images on three pages corresponding to 3 A4 size sheets (210×297 mm) are written at predetermined intervals on the photoreceptor belt 14.

First, a photoreceptor belt circulation cycle reference value t0, and reference paper pickup times for times t1, t2 and t3 for sequentially picking up three sheets of paper 31 from the point in time of a recognition pattern arrival signal. t0, t1, t2 and t3 are set as initial values, in step 100. For example, when the photoreceptor belt 14 travels at a uniform speed of 3.2 inch/sec, the photoreceptor belt (14) circulation cycle reference value t0 is set as 10 sec. t1, t2 and t3 are set in association with the time for scanning images of each page onto the photoreceptor belt 14. A case where t1 is set as 1.2 sec, the paper pickup interval time is set as 3.3 sec, t2 is set as 5.5 sec, and t3 is set as 8.8 sec will now be described as an example.

The initialization process is performed during the production process of a printer or after the photoreceptor belt 14 is replaced.

After initialization, a printing operation starts on the receipt of image data, in step 110. When printing starts, the engine controller 70 drives the photoreceptor belt 14 to circulate at a predetermined speed, and outputs a paper supply signal to the paper pickup timing correction portion 50.

Next, the paper pickup timing correction portion 50 determines whether a recognition pattern arrival signal is received, in step 120.

If it is determined in step 120 that the recognition pattern arrival signal is received, the timer 51 starts counting time, in step 130.

Meanwhile, the engine controller 70 controls the printing portion 10 to form images on the photoreceptor belt 14 at a set time in synchronization with the recognition pattern arrival signal.

The paper pickup timing correction portion 50 controls the pickup roller driving portion 60 so that a sheet of paper 31 is picked up at every reference paper pickup time t1, t2 and t3 from the input of the recognition pattern arrival signal, in step 140. For example, when the time counted by the timer 51 is 1.2 sec being the first paper pickup reference time t1, the paper pickup timing correction portion 50 outputs a signal for driving the pickup roller 33 to the pickup roller driving portion 60. Then, the pickup roller driving portion 60 drives the pickup roller 33. Similarly, when the time counted by the timer 51 is 5.5 sec being the second paper pickup reference time t2, the pickup roller 33 is driven under the control of the paper pickup timing correction portion 50. Next, when the time counted by the timer 51 is 8.8 sec being the third paper pickup reference time t3, the pickup roller 33 is driven under the control of the paper pickup timing correction portion 50.

As described above, sheets of paper 31 are picked up at the set paper pickup reference times t1, t2 and t3 until the photoreceptor belt 14 circulates once starting from initial printing. When a paper supply signal for continuing image printing is output by the engine controller 70, it is determined whether a next recognition pattern arrival signal is received, in step 210.

When the next recognition pattern arrival signal is received, a recognition pattern arrival signal generation interval time (ta) is calculated, the interval time (ta) corresponding to the difference between the time when the recognition pattern arrival signal is currently received and the time when it has been previously received, in step 220. The recognition pattern arrival signal generation interval time (ta) corresponds to the time counted by the timer 51 until the recognition pattern arrival signal is received. The timer 51 is reset and resumes counting when the recognition pattern arrival signal is received.

A paper pickup time correction value (A) is obtained from the set circulation cycle reference value (t0) and the generation interval time (ta) obtained in step 220, in step 230. The paper pickup time correction value (A) is obtained by subtracting the generation interval time (ta) from the circulation cycle reference value (t0).

Thereafter, values t1+A, t2+A, and t3+A, obtained by adding the correction value A to each of the set paper pickup reference times t1, t2 and t3, are set as paper pickup correction times, in step 240.

The pickup roller 33 is driven in step 250, whenever the time counted from receiving the recognition pattern arrival signal in step 210 reaches the paper pickup correction times (t1+A), (t2+A), and (t3+A) obtained in step 240.

Meanwhile, according to the control of the paper pickup time, only the feeding interval between sheets of paper 31 fed before and after generation of the recognition pattern arrival signal is controlled in response to a variation in the recognition pattern arrival signal generation interval time.

That is, the interval between the time t3 for picking up a sheet of paper 31 before generation of the second recognition pattern arrival signal and the time for picking up a sheet of paper 31 after generation of the second recognition pattern arrival signal is controlled by the correction value (A). The intervals (t2−t1) and (t3−t2) between times (t2+A) and (t3+A) for picking up fifth and sixth sheets of paper on the basis of the time (t1+A) for picking up a fourth sheet of paper are maintained constant.

Thereafter, while a paper supply signal is continuously output by the engine controller 70, step 200, which includes steps 210 through 250, is repeated.

In a paper supply control apparatus and a paper supply method according to the present invention as described above, a paper pickup time is controlled in response to a variation in the circulation cycle of a photoreceptor belt so that the supplying interval between sheets of paper to be sequentially picked up from a paper feeding cassette is not narrowed below a predetermined interval. Therefore, generation of a paper jam between supplied sheets of paper is prevented and the number of image printing errors is reduced.

What is claimed is:

1. A paper supply controlling apparatus in a printer comprising:

a pickup roller for picking up sheets of paper loaded in a paper feeding cassette and transferring the picked-up sheets of paper to a paper supply path leading to a transfer unit in a printer;

a pickup roller driving portion for driving the pickup roller;

a recognition pattern detecting sensor for detecting passage of a recognition pattern formed on a circulating photoreceptor belt and outputting a recognition pattern arrival signal upon detection of said recognition pattern; and a paper pickup timing correction portion for determining a variation in a circulation cycle of the photoreceptor belt from a predetermined reference value of the circulation cycle of the photoreceptor belt, and controlling the pickup roller driving portion to compensate for the variation that is determined.

2. The paper supply controlling apparatus in a printer of claim 1, wherein the paper pickup timing correction portion has a correction value determined by subtracting a time interval between a currently-input recognition pattern arrival signal and a previously-input recognition pattern arrival signal from said predetermined reference value of the circulation cycle of the photoreceptor belt, and wherein said paper pickup timing correction portion controls the pickup roller driving portion to drive the pickup roller at times obtained by adding said correction value to a plurality of pickup reference times for sequentially picking up sheets of paper on the basis of the time when the recognition pattern arrival signal is received.

3. A paper supplying method for a printer having a pickup roller, a pickup roller driving portion, a recognition pattern detecting sensor, a circulating photoreceptor belt, and a paper pickup timing correction portion, the method comprising the steps of:

(a) setting initial values for a reference value of a circulation cycle of the photoreceptor belt, and a plurality of paper pickup reference times for sequentially picking up sheets of paper after a time when a recognition pattern on said circulating photoreceptor is detected;

(b) receiving a recognition pattern arrival signal at the paper pickup timing portion when said recognition pattern detecting sensor detects said recognition pattern;

(c) calculating a generation time interval between a currently-input recognition pattern arrival signal and a previously-input recognition pattern arrival signal;

(d) determining a paper pickup time correction value by subtracting the generation time interval obtained in step (c) from the reference value of the circulation cycle;

(e) adjusting said plurality of paper pickup times by adding the paper pickup time correction value determined in step (d), to each of said plurality of paper pickup reference times, thereby to generate a plurality of adjusted paper pickup times; and (f) supplying sheets of paper to the printer by driving the pickup roller at the plurality of adjusted paper pickup times.

4. An electrostatic printing apparatus having a self-adjusting paper supply comprising:

a circulating photoreceptor belt for forming an electrostatic image and transferring a developing agent deposited on said electrostatic image to a plurality of paper sheets in a paper supply path;

paper supplying means for supplying individual paper sheets into said paper supply path to receive said developing agent transferred from said circulating photoreceptor;

a recognition pattern detecting sensor for detecting a recognition pattern formed on said circulating photoreceptor, said recognition pattern detecting sensor outputting a recognition arrival signal when said recognition pattern is detected; and a paper pick up timing correction portion for adjusting a pick up time of the individual paper sheets of said paper supplying means, said paper pick up timing correction portion receiving recognition arrival signals from said recognition pattern detecting sensor and adjusting said pick up time based upon variances of time between successive recognition arrival signals and a predetermined reference time of a photoreceptor circulation cycle.

5. The electrostatic printing apparatus according to claim 4, wherein sail paper supplying means comprises a paper pick up roller to pick up said individual paper sheets and a paper pick up roller driving unit for driving said paper pick up roller according to adjustments of said pick up time from said paper pick up timing correction portion.

6. The electrostatic printing apparatus according to claim 5, further comprising a plurality of scanning units for optically scanning image data onto said circulating photoreceptor belt to form said electrostatic image; a plurality of developer units for depositing a plurality of developing agents onto the electrostatic image formed on said circulating photoreceptor belt; and a transfer unit for transferring said developing agents deposited onto the electrostatic image formed on said photoreceptor belt to said individual paper sheets.

* * * * *